US008552863B2

(12) United States Patent
Kumbhar et al.

(10) Patent No.: US 8,552,863 B2
(45) Date of Patent: Oct. 8, 2013

(54) INTEGRATED MOBILE IDENTIFICATION SYSTEM WITH INTRUSION SYSTEM THAT DETECTS INTRUDER

(75) Inventors: Amod Gajanan Kumbhar, Bangalore (IN); Pankaj Yadav, Bangalore (IN); Ramprasad P, Sirkali (IN)

(73) Assignee: Honeywell International Inc., Morristown, NJ (US)

( * ) Notice: Subject to any disclaimer, the term of this patent is extended or adjusted under 35 U.S.C. 154(b) by 345 days.

(21) Appl. No.: 12/904,563

(22) Filed: Oct. 14, 2010

(65) Prior Publication Data

US 2012/0092158 A1 Apr. 19, 2012

(51) Int. Cl.
*G08B 13/00* (2006.01)

(52) U.S. Cl.
USPC ..... 340/541; 340/539.11; 340/539.13; 455/456.1; 455/457

(58) Field of Classification Search
USPC ..... 340/539.11, 539.15, 539.22, 541, 565, 340/567, 539.13; 455/456.1, 457; 713/166
See application file for complete search history.

(56) References Cited

U.S. PATENT DOCUMENTS

| | | | | |
|---|---|---|---|---|
| 7,636,842 | B2 * | 12/2009 | Kumoluyi et al. | 713/166 |
| 2006/0009240 | A1 * | 1/2006 | Katz | 455/457 |
| 2007/0182538 | A1 * | 8/2007 | Ota et al. | 340/506 |
| 2009/0247184 | A1 | 10/2009 | Sennett et al. | |
| 2009/0328214 | A1 * | 12/2009 | Dawson | 726/23 |
| 2010/0015948 | A1 * | 1/2010 | Nagano | 455/410 |

* cited by examiner

*Primary Examiner* — Brent Swarthout
(74) *Attorney, Agent, or Firm* — Husch Blackwell

(57) ABSTRACT

A method and apparatus are provided for identifying wireless devices within a security system. The method includes the steps of providing a security system monitoring a secured area for an intruder, the security system detecting an intrusion of the secured area, the security system detecting a mobile device within the secured area, the security system retrieving an identifier of the intruder from the mobile device and the security device saving the identifier along with a record of the intrusion.

21 Claims, 1 Drawing Sheet

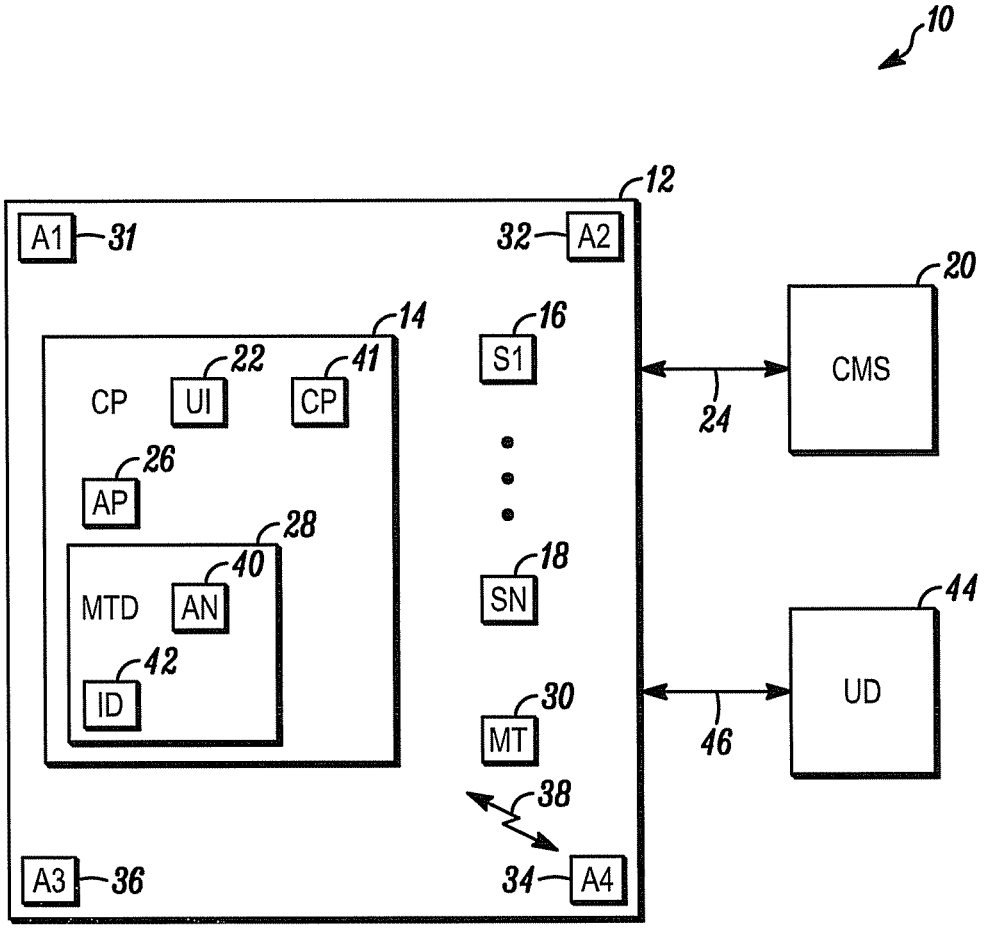
10
12
A1
31
32
A2
20
14
16
S1
22
41
CP
UI
CP
CMS
24
26
AP
28
40
18
MTD
AN
SN
44
42
ID
30
UD
MT
46
38
A3
36
34
A4

INTEGRATED MOBILE IDENTIFICATION SYSTEM WITH INTRUSION SYSTEM THAT DETECTS INTRUDER

FIELD OF THE INVENTION

The field of the invention relates to security systems and in particular to methods of identifying intruders.

BACKGROUND OF THE INVENTION

Security systems are generally known. Such systems typically include a physical barrier (e.g., walls, doors, etc.) that define and protect a secured area and number of sensors placed around a periphery or within the secured area to detect intruders. The sensors may include one or more switches placed on doors or windows. The sensors may also include passive infrared (PIR) detectors, motion detectors and a number of security cameras.

The security cameras may be monitored either locally or remotely for intruders. Alternatively, a video stream from each of the video cameras may be analyzed by a computer processor on a frame-by-frame basis to detect the motion of an intruder based upon differences between successive frames.

The sensors of a security system are typically connected to a common control panel. The control panel may be armed or disarmed by an occupant through a user interface on the control panel. Once armed, the control panel may monitor each of the sensors. Upon activation of an intrusion sensor, the control panel may activate a local audible alarm and/or send an alarm signal to a central monitoring station.

While such systems work well, they are often not as effective as they could be. For example, even when a local control panel is connected to a central monitoring station and police are dispatched immediately after detection of intrusion, the police often don't arrive in time to capture the intruder. Often the secured area is remote from police facilities or police units are not available in the area when an alarm is reported. Alternatively, police may be preoccupied with other matters. Accordingly, a need exists for better methods of identifying intruders.

BRIEF DESCRIPTION OF THE DRAWING

FIG. 1 is a diagram of a security system in accordance with an illustrated embodiment of the invention.

DETAILED DESCRIPTION OF AN ILLUSTRATED EMBODIMENT

FIG. 1 is a block diagram of a security system 10 used to protect a secured area 12, shown generally in accordance with an illustrated embodiment of the invention. Included within the security system 10 may be a control panel 14 and a number of intrusion sensors 16, 18.

The intrusion sensors 16, 18 may be distributed around a periphery of the protected area 12 and may include any of a number of door sensors, window sensors or motion sensing devices. The sensors 16, 18 may also include one or more security cameras either with or without motion detection capability.

Included on or nearby the control panel 14 may be a user interface (e.g., keypad, display, etc.) 22. The user interface 22 may be used to arm or disarm the security system 10. The user may select an arm mode including an arm stay mode where only the sensors 16, 18 along a periphery of the secured area 12 are monitored or an alarm away mode where all sensors 16, 18 are monitored.

Once armed, an alarm processor 26 within the alarm panel 14 may monitor the sensors 16, 18 for intruders. Upon detecting the activation of a sensor 16, 18 by an intruder, the alarm panel 14 may enter an alarm state. Entering an alarm state may mean activating a local audio/visual alarm indicator and sending an alarm message 24 to a central monitoring station 20. The alarm message 24 may include an identifier of the alarm panel 14 and/or identifier of the secured area 12, a time and also an identifier of the sensor 16, 18 that was activated. The central monitoring station 20 may respond by alerting a local police department.

Under illustrated embodiments of the invention, the alarm system 10 may also include a wireless device detector and identifier (device detector) 28 that detects portable wireless transceiver devices 30 located within the secured area 12. Once a portable device 30 is detected, the transceiver detector 28 establishes a communication connection with the portable device 30 and downloads an identifier of the device 30. In the event of an alarm, the device detector 28 may proceed to identify any devices 30 within the secured area 12 and include the identifier of the device 30 within the alarm message 24 sent to the central station 20.

For example, most people carry some form of portable device (e.g., cell phone, Blackberry, etc.) 30 with them at all times for their personal use. It could also be assumed that a burglar or some other person involved in breaking and entering would also carry some form of device 30. By identifying the device 30 at the instance of (or in conjunction with) an alarm, the alarm system 10 could also potentially identify the party perpetrating the crime and report the identifier of the party to the central station 20 along with the alarm 24.

Moreover, it would not matter what operational state the device 30 remains in, so long as the device 30 is activated. For example, a burglar may place the device 30 in a silent mode and the device 30 would still respond when queried for an identifier by the device detector 28.

In general, the device detector 28 may be activated each time the user places the alarm panel 14 into the alarm away mode. Once in the alarm away mode, the alarm panel 14 may cause the device detector 28 to begin continuously scanning for portable devices 30. Alternatively, the device detector 28 may only begin scanning for and detecting portable devices 30 when a sensor 16, 18 is activated and where such activation indicates the presence of an intruder.

Alternatively, the device detector 28 may operate as an independent system driven directly by the sensors 16, 18. In this case, activation of any sensor 16, 18 may cause the device detector to begin scanning for portable devices 30. However, in this situation, the device detector has its own arming and disarming options, alarm detection mode, monitoring mode, etc.

Where operated as an independent system, the device detector 28 may have one or more hardwired inputs and outputs. As an input, the device detector 28 can connect to any wired or wireless security detector (e.g., a door open switch that detects devices 30 when a perimeter doors is opened). Similarly, the device detector 28 can be connected to any wired or wireless output (e.g., a security camera that collects images of an area in which a device 30 is detected).

Scanning for portable devices 30 may mean polling the control channels of a local communication service providers (e.g., cellphone, WIFI, etc.) and/or satellite service providers for devices 30. The device detector 28 may force any portable device 30 within the area to begin communicating with the device detector 28. Forcing in this case means depriving the portable device 30 of the ability to detect signals through a normally available base station of a nearby public communication network. As known by those of skill in the art, when a portable device 30 loses contact with a nearby base station, the portable device 30 will scan for and re-establish communication with any nearby base station.

The portable device 30 may seek another nearby base station upon entering the secured area 12 because of a loss of signal that occurs automatically in response to signal attenuation caused by a set of walls surrounding the secured area 12. Alternatively, an interfering signal 38 may be transmitted into the secured area 12 from the device detector 28 through a set of directional antenna 31, 32, 34, 36 located along a periphery of the secured area 12.

Scanning for devices 30 by the detector 28 may occur under any of a number of different formats (e.g., FDMA, TDMA, GSM, WiFi, UMTS, HSPDA, cdma2000x EVDO, cdma2000 3x, TD-SCDMA, WCDMA, EDGE, IMT-2000, DECT, etc.) on a control channel used under the format. The control channels under each format may be located at a predetermined narrowband frequency (e.g., as under GSM, WiFi, etc.) or a range of frequencies (e.g., as under cdma2000, etc.).

In each case, the detector 28 may select a format (e.g., GSM) and frequency range (e.g., 900 to 1800 MHz) appropriate for the location of the secured area 12 and begin transmitting a control signal. In this case, the detector 28 may sequentially transmit on each control channel for a short time period (e.g., a few milliseconds) and move on to the next control channel. The detector 28 may repeat this process for each control channel of each selected format.

Once the detector has scanned the control channels of a first selected format, the detector may select another format (e.g., WiFI) and repeat the process. In each case, the detector may poll for any devices 30 or simply transmit a signal that emulates the signals of local base stations of the public cellular or other network and wait for a registration message from the device 30.

The signals transmitted on the control channels may be transmitted by the detector device 28 through a set of peripheral antenna 31, 32, 34, 36 or through a more centrally located antenna 40 having a relatively limited range (e.g., 20 meters). As soon as the detector device 28 receives a signal from the portable device 30, the detector device 28 may stop temporarily stop sequencing through the control channels and begin to set up a connection link with the device 30.

As those of skill in the art would understand, registration of a portable device 30 within a public communication network requires a series of challenges and responses in order to verify that the device 30 is entitled to register and use the public communication network. In a similar manner, the detector device 28 may also issue one or more challenges and/or requests to the portable device 30 that require the portable device 30 to respond with an appropriate identifier (e.g., IMEI, ICC-ID, IIN, SIM, etc.). In response to the one or more challenges and/or requests, the portable device 30 returns the requested identifier 42 to the detector device 28.

Upon receipt of an identifier 42 from a device 30, the detector device 28 may request verification of the authenticity of the identifier (either directly or through the panel 14) and request further information from a local public communication system database or simply transfer the identifier 42 to the alarm panel 14. The request for verification and further information may include a request for a name of an registered user of the portable device 30. The public communication system may respond by transmitting the name of the registered user to the detector device 28. The detector device 28, in turn, may transfer the name to the alarm panel 14.

Once the detector device 28 has received the identifier from the portable device 30, the detector device 28 may continue scanning control channels. In this case, the detector device 28 may continue this process until another portable device 30 is detected or until all of the control channels have been scanned.

Within the alarm panel 14, a communication processor 41 may receive notification of an alarm via activation of one or more of the sensors 16, 18 and also the identifier 42 of the registered user of the portable device 30. In response, the communication processor 41 may compose an alarm message 24 that is transferred (either wirelessly or through a wired connection) to the central monitoring station 20.

In addition to or as an alternative to notifying the central monitoring station 20, the communication processor 41 may also send a message directly to other concerned parties (e.g., the police). The communication processor 41 may also send an alarm message 46 to an authorized user 44 including the identifier of the device 30. The message may be sent under any of a number of different formats (e.g., GSM, SMS, GPRS, e-mail, etc.).

In general, the detector device 28 may begin scanning whenever the alarm panel 14 is placed into the alarm away mode or only upon detecting the activation of one of the sensors 16, 18. The detector device 28 may remain inactive during the alarm stay mode in order not to interfere with the operation of authorized portable devices 30 (e.g., a portable device used by a home owner, a neighbor, etc.). Alternatively, the detector device 28 may retain a list of authorized portable devices 30 and exclude the identifiers of any authorized devices 30 from alarm reports 24.

In another embodiment, the system 10 may contain a list of suspect identifiers 42. The list of suspect identifiers 42 may be those associated with known criminals or other persons who should not be in the vicinity of the secured area 12. In this case, detection of a suspect identifier 42 may be used to trigger an alarm and the reporting of the alarm to the central monitoring station 20 or authorized party 44 without an alarm or other activation of a sensor 16, 18.

In another embodiment, the detector device 28 may also be used in the alarm stay mode. In this case, any time an identifier of an authorized portable device 30 is detected, the detector device 28 may cease operation for some time period. This may be necessary to allow the homeowner to make an emergency call to police without interference caused by the detector device 28 during a break in. After the time period the detector device 28 may resume normal operation or resume operation on channels other than any channel on which an authorized portable device 30 was detected.

In general, the detector device 28 may be constructed with a power level and sensitivity to detect portable devices 30 at locations within the secured area 12 and also locations outside, but very close to the secured area 12. This may be important to detect intruders who are lurking outside and who attempt to force entry, but flee upon hearing an audible alarm. While this expanded area of coverage may also recover the identifiers of innocent passers-by, the possibility that the identity of the intruder could also be included within a list of detected identifiers could be invaluable information to police in a later investigation where the police have no other way of identifying who triggered an alarm.

Moreover, it may also be useful to for the system 10 to collect identifiers 42 even in the absence of an alarm. In this case, the system 10 may be set up to collect identifiers 42 in any given area up to 10 meters distance outside of the secured area 12. This may be important where an intruder has entered (broken) into the secured area 12 in the region of a bypassed sensor 16, 18. In this case, the system 10 would still be able to detect the identifier 42 of the intruder.

Intrusions may also occur while the security system 10 is in a disarmed state. In order to address this situation, the system 10 may be configured to simply collect identifiers 42 continuously along with a time of detection and save such information in a file. If it should later be determined that there has been a break-in, then the file may be reviewed to identify any possible suspects based upon a content of the file.

In other situations where the secured area 12 was burglarized and the police were not able to respond to the burglary before the intruder had left the secured area 12, the reported identifier 42 can be used by the police to track the intruder. This may be very important where the intruder has stolen evidence that the burglar may soon dispose of, thereby leaving the police with less evidence of the burglary.

In this case, the police can use the identifier 42 in conjunction with GPS location present within many portable devices 30 to identify the location of the intruder after the intruder has left the protected premises. Alternatively, the police may use directional information from nearby base stations of the public communication system to locate the intruder.

Moreover, the intruder would not be safe even if the intruder where to deactivate his portable device 30 after leaving the protected area 12. In this case, when ever the intruder were to later reactivate his/her portable device 30, the police may be able to immediately locate the intruder using the identifier 42 through either GPS or directional information from the public communication system.

In still another embodiment, the system 10 can be implemented as a passive system to continuously detect identifiers 42. In this case, the detector 28 may be placed adjacent an area that would inherently cause the mobile device 30 attempt to register with a local base station (e.g., near a metal detector at a building entrance). In this case, the metal detector causes the mobile device 30 to become ineffective for a period while the mobile device 30 moves beyond the range of the metal detector. In this situation, the detector 28 may obtain an identifier of the mobile device 30 during that period and save the identifier 42 for later consideration in the event of some unusual or criminal incident. Also, in this situation, the identifier may be saved in a list of identifiers and if one of the identifiers crosses into a restricted area, the detector 28 may generate an alarm.

A specific embodiment of method and apparatus for identifying intruders has been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention and any and all modifications, variations, or equivalents that fall within the true spirit and scope of the basic underlying principles disclosed and claimed herein.

The invention claimed is:

1. A method comprising:

providing a security system monitoring a secured area for an intruder;

the security system detecting an intrusion of the secured area;

the security system detecting a mobile device within the secured area;

the security system forcing the mobile device to communicate with the security system by depriving the mobile device of an ability to detect signals through a base station or through a local publically accessible communication network;

the security system retrieving an identifier of the intruder from the mobile device; and the security system saving the identifier along with a record of the intrusion.

2. The method as in claim 1 further comprising transferring the identifier to a central monitoring station.

3. The method as in claim 1 further comprising providing a list of authorized mobile devices and deleting a detected identifier that matches an entry within the list of authorized mobile devices or providing a list of suspect mobile identifiers and generating an alarm when the security system receives an identifier that matches an entry within the list of suspect identifiers.

4. The method as in claim 1 further comprising tracking the intruder via the mobile device after the intruder leaves the secured area.

5. The method as in claim 4 wherein tracking further comprises retrieving a GPS signal from the mobile device.

6. The method as in claim 1 wherein the identifier further comprises one of an IMEI, an ICC-ID, an IMSI and IIN and a SIM number.

7. The method as in claim 1 further comprising establishing communication with the mobile device on one of a set of control channels of the mobile device.

8. An apparatus comprising:

an alarm system;

a plurality of sensors within the alarm system that detect an intruder; and a detector device within the alarm system that wirelessly scans a set of control channels of a local publically accessible communication network, detects a portable device carried by the intruder via one of the set of control channels, forces the portable device to communicate with the detector device by depriving the portable device of an ability to detect signals through the local publically accessible communication network, and retrieves an identifier of the portable device.

9. The apparatus as in claim 8 wherein the identifier further comprises one of an IMEI, an ICC-ID, an IMSI and IIN and a SIM number.

10. The apparatus as in claim 8 wherein the portable device further comprises a cellular telephone.

11. The apparatus as in claim 8 further comprising the portable device operating under one of a FDMA, TDMA, GSM, WiFi, UMTS, HSPDA, cdma2000x EVDO, cdma2000 3x, TD-SCDMA, WCDMA, EDGE, IMT-2000 and DECT format.

12. The apparatus as in claim 8 wherein the detector device emulates a base station of the publically accessible communication network.

13. The apparatus as in claim 8 further comprising a metal detector that causes the portable device to register with the detector device.

14. The apparatus as in claim 8 further comprising an alarm message sent from the alarm system to a central monitoring station including the identifier.

15. An apparatus comprising:

an alarm system that protects a secured area;

a plurality of sensors coupled to the alarm system that detect intrusion by an intruder into the secured area, the intruder carrying a portable wireless communication device;

a publically accessible communication network; and a detector device within the alarm system that wirelessly scans a set of control channels of the publically accessible communication network, forces the portable device to communicate with the detector device by depriving the portable device of an ability to detect signals through the publically accessible communication network, receives a registration message from the portable device via one of the set of control channels, and retrieves an identifier of the portable device.

16. The apparatus as in claim 15 wherein the identifier further comprises one of an IMEI, an ICC-ID, an IMSI and TIN and a SIM number.

17. The apparatus as in claim 15 wherein the portable device further comprises a cellular telephone.

18. The apparatus as in claim 15 further comprising the portable device operating under one of a FDMA, TDMA, GSM, WiFi, UMTS, HSPDA, cdma2000x EVDO, cdma2000 3x, TD-SCDMA, WCDMA, EDGE; IMT-2000 and DECT format.

19. The apparatus as in claim 15 wherein the detector emulates a base station of the publically accessible communication network.

20. The apparatus as in claim 15 further comprising an alarm message including the identifier sent from the alarm system to a central monitoring station.

21. The method as in claim 1 wherein the security system forcing the mobile device to communicate with the security system further comprises the security system causing the mobile device to seek communication with the security system.

* * * * *